US006192571B1

(12) United States Patent
Morrison

(10) Patent No.: US 6,192,571 B1
(45) Date of Patent: Feb. 27, 2001

(54) APPARATUS AND METHOD FOR FORMING STIFFENING MEANS

(76) Inventor: Andrew Morrison, Westfield, Caster Road, Market Rasen Lincolnshire (GB), LN8 3JA ( * ) Notice: Subject to any disclaimer, the term of this patent is extended or adjusted under 35 U.S.C. 154(b) by 0 days.

(21) Appl. No.: 09/194,381

(22) PCT Filed: May 27, 1997

(86) PCT No.: PCT/GB97/01443

§ 371 Date: Nov. 25, 1998

§ 102(e) Date: Nov. 25, 1998

(87) PCT Pub. No.: WO97/45253

PCT Pub. Date: Dec. 4, 1997

(30) Foreign Application Priority Data

May 28, 1996 (GB) ..... 9612129

(51) Int. Cl.[7] ..... B21D 39/03

(52) U.S. Cl. ..... 29/428; 29/458; 29/771; 29/772

(58) Field of Search ..... 29/458, 771, 772, 29/773, 281.1, 897.32, 469.5, 428; 72/385, 381

(56) References Cited

U.S. PATENT DOCUMENTS

| | | | | |
|---|---|---|---|---|
| 2,481,049 | * | 9/1949 | Stamm | 72/385 |
| 3,110,340 | * | 11/1963 | Valverde | 153/21 |
| 3,461,711 | * | 8/1969 | Ogilvie | 72/385 |
| 3,828,705 | * | 8/1974 | Morrison | 72/385 |
| 3,892,119 | * | 7/1975 | Miller | 72/385 |
| 4,109,503 | * | 8/1978 | Francon | 72/379.6 |
| 4,596,542 | | 6/1986 | Moen . | |

FOREIGN PATENT DOCUMENTS 2269580 2/1994 (GB) .

* cited by examiner

*Primary Examiner*—P. W. Echols
*Assistant Examiner*—Anthony L. Green
(74) *Attorney, Agent, or Firm*—Richard M. Goldberg

(57) ABSTRACT

An apparatus and method for forming re-enforced stiffening means such as panels for use in palletainers, re-enforcement being provided by ribs in which said ribs are shaped, folded and secured to a panel.

17 Claims, 5 Drawing Sheets

APPARATUS AND METHOD FOR FORMING STIFFENING MEANS

BACKGROUND OF THE INVENTION

This invention relates to apparatus and a corresponding method of forming stiffening panels for use with palletainers and other types of storage containers.

"Palletainers" is a term used in the art to designate containers intended for use in association with pallets to hold materials, such as vegetables, in cold store. A palletainer comprises a cardboard structure known as a "sleeve". The container sleeve defines the side walls of a container for materials.

In order to maintain the requisite rectangular shape of the cardboard sleeve of the palletainer, an internal stiffening structure or skeleton is provided. Such a skeleton is in the form of stiffening panels for the side walls of the sleeve and the panels are inserted into the sleeve of the palletainer so as to lie substantially face-to-face therewith.

A stiffening panel for a palletainer comprises a planer panel or flat cardboard sheet carrying a plurality of transverse stiffening elements or ribs of a V section, these being bonded to the planer panel. Four such panels are inserted into the palletainer sleeve, one for each face, with the ribs on the inboard face of each panel. Palletainers and stiffening means therefore are described in my Patent number GB 2269580.

It has been found that the construction of stiffening panels formed with bonded ribs is difficult and time consuming, particularly with respect to the correct formation of the stiffening ribs and secure bonding of same to the planer panels.

An object of the invention is to provide apparatus and a method offering improvements in relation to matters discussed above and elsewhere herein or improvements generally.

According to the invention there is provided apparatus and methods as defined in the accompanying claims.

In an embodiment of the invention there is provided apparatus for forming reinforced stiffening panels for use with palletainers or like product containers wherein reinforcement of panels is provided by stiffening elements in the form of ribs wherein means are provided to form said ribs by the shaping and folding of a rib blank and securing same to said panel.

The apparatus for forming stiffening panels having stiffening elements in the form of ribs comprises a substantially horizontal support means or bed onto which a planer panel may be received. Located above the bed are a plurality of forming assemblies which act to shape and fold the stiffening ribs. Each station is adapted to receive a rib blank, fold and shape the blank into the required configuration, generally being of a V-shaped section and secure it to the planer panel.

The rib blank generally consists of a pre-creased strip of corrugated card or the like. Pre-creased blanks are made by a stamping/creasing process and machine (not shown). The creases formed therein generally comprise a central primary crease and two secondary creases placed one on either side of the primary crease. The advantage of using a pre-creased rib blank is that when the blank is shaped and folded, such folding is predictable occurring along the lines of the creases. It also facilitates "clean" folding and is energy efficient as less energy is required to produce a fold along a crease as would be required to produce a fold in a non-creased blank.

The forming assemblies comprise a support means for a rib blank, a first forming element or forming bar, roller means, an adhesive reservoir and a second forming element or former, together with means for actuating the abovementioned elements. The forming assemblies are supported on a framework, located above the bed, and are moveable in respect to one another on the framework. This enables the stations to be moved closer together or further apart depending on the specification of the panels required, namely the number and relative spacings of the ribs on any particular panel.

Support means such as locating brackets, guide rails, runners or frame are provided to give initial support to a rib blank during the shaping and folding operation/process. The support means extend along the length of the bed and outwardly past and to one side of the apparatus. In addition to providing initial support to the rib blank, the guide acts as a feeder means by which the rib blank is presented in the required position for shaping and folding.

When the rib blank is placed on the supporting frame, one end of the blank abuts spaced rollers. When activated, the rollers exert a gripping action on the edge of the roller and cause it to be moved along the guide into a second position located above the bed.

As the rollers begin to act on the rib blank, a measured amount of a hot melt adhesive is dispensed to the rollers from an adhesive reservoir, each forming assembly has a dedicated adhesive reservoir. As the rollers advance the rib blank, they act to distribute the adhesive along the edges of the rib blank.

As the rib blank moves along the guide so as to be located above the bed, a forming bar is also caused to advance, with the rib blank, towards the bed. The forming bar is located beneath the support for the rib blank. Each forming station is provided with a forming bar. The forming bar is generally an elongate metal fabrication. The particular shape and configuration of the forming bar is dependent on the shape required for the stiffening element. When a stiffening element of substantially V-shaped cross section is required, the cross sectional shape of the forming bar is of an inverted T.

Located above the bed onto which the planer panel is received is a former, each forming assembly has a dedicated former. Each former comprises a substantially inverted V shaped elongate metal fabrication, the sides or arms of the inverted V have a hinged or spring loaded edge portion. The edges of the sides or arms of the fabrication are finished with a rounded or rolled edge which prevents the edge catching on and possibly tearing the material of the rib blank. Actuating means, such as hydraulic or pneumatic rams are provided which act to move each former in a generally downwardly direction towards the rib blank.

In use, a planer panel to receive reinforcing ribs is fed into the apparatus and located on the bed. Pre-creased rib blanks are placed on the guide frame with the non creased side uppermost and are moved along the guide frame by the rollers so as to be located above the planer panel. As the rib blank moves along the guide frame, a measured amount of adhesive is delivered to the edges of the blank. As the blank advances towards the bed, the forming bar also advances towards the bed, being located below the rib blank. Both are moved sufficiently over the bed so as to be located beneath the former.

Once the rib blank and the forming bar are in the required position, beneath the former, actuation means cause the former to move in a downwardly direction towards the rib blank. Continued movement of the former causes it to come into direct contact with the rib blank. This continued downward pressure causes the blank to be dislodged from the guide rail and brought into contact with the forming bar located beneath it. The area of contact between the rib blank and the upstanding portion of the forming bar is the region of the primary crease. The pressure applied by the former acting on the blank which is now in contact with the forming bar, said forming bar resisting this downward pressure. This causes the blank to fold along the central pre-formed crease, around the forming bar. Due to the substantially triangular shape of the former, one arm of the former passes either side of the forming bar. The hinged or spring loaded edges or arms of the former act to exert a gripping action on the blank as it is bent around the former. This gripping action is exerted in the region of the remaining pre-formed creases and serves to prevent the blank from flattening out as it is bent around the forming bar but rather to push or "pinch" together the regions of the blank which have been bent around the forming bar. The action of the spring loaded arms in preventing the blank from flattening out as it is folded along the crease serves to form the sides of the rib which is upstanding from the planer sheet and substantially triangular. The rolled or rounded edges of the spring loaded or hinged portions of the former assist the pinching action by moving cleanly over the surface of the rib blank and presenting no sharp edges which may "catch" on the rib blank and cause damage.

The gripping or pinching action of the former also acts to assist the bonding of the formed rib to the planer panel. By exerting pressure in the region of secondary preformed creases in the rib blank to "pinch" the sides of the forming rib together, this results in the region of the rib blank between the secondary pre-formed creases and the longitudinal edge of the blank retaining a substantially horizontal attitude. The continuing downward pressure of the former pushes the rib blank from the guide rails and towards the planer panel. This causes the substantially horizontal regions of the rib blank to contact the upper face of the planer panel. The adhesive which is carried on the edges of the rib blank cures and bonds the now shaped and formed rib to the planer panel.

Once the rib has been shaped, formed and bonded to the planer panel, the former is moved away from the bed in an upwardly direction and the forming bar is retracted away from the bed. The planer panel, now bearing reinforcing ribs, is removed from the bed and the process repeated.

In a further embodiment of the invention there is provided a method of forming re-enforced stiffening panels for use with palletainers or like product containers wherein reinforcement of panels is provided by stiffening elements in the form of ribs comprising the steps of causing folding and shaping of a rib blank to form a rib and the step of securing same to a panel.

Embodiments of the present invention will now be described by way of example with reference to the accompanying drawings in which.

Figure 1:
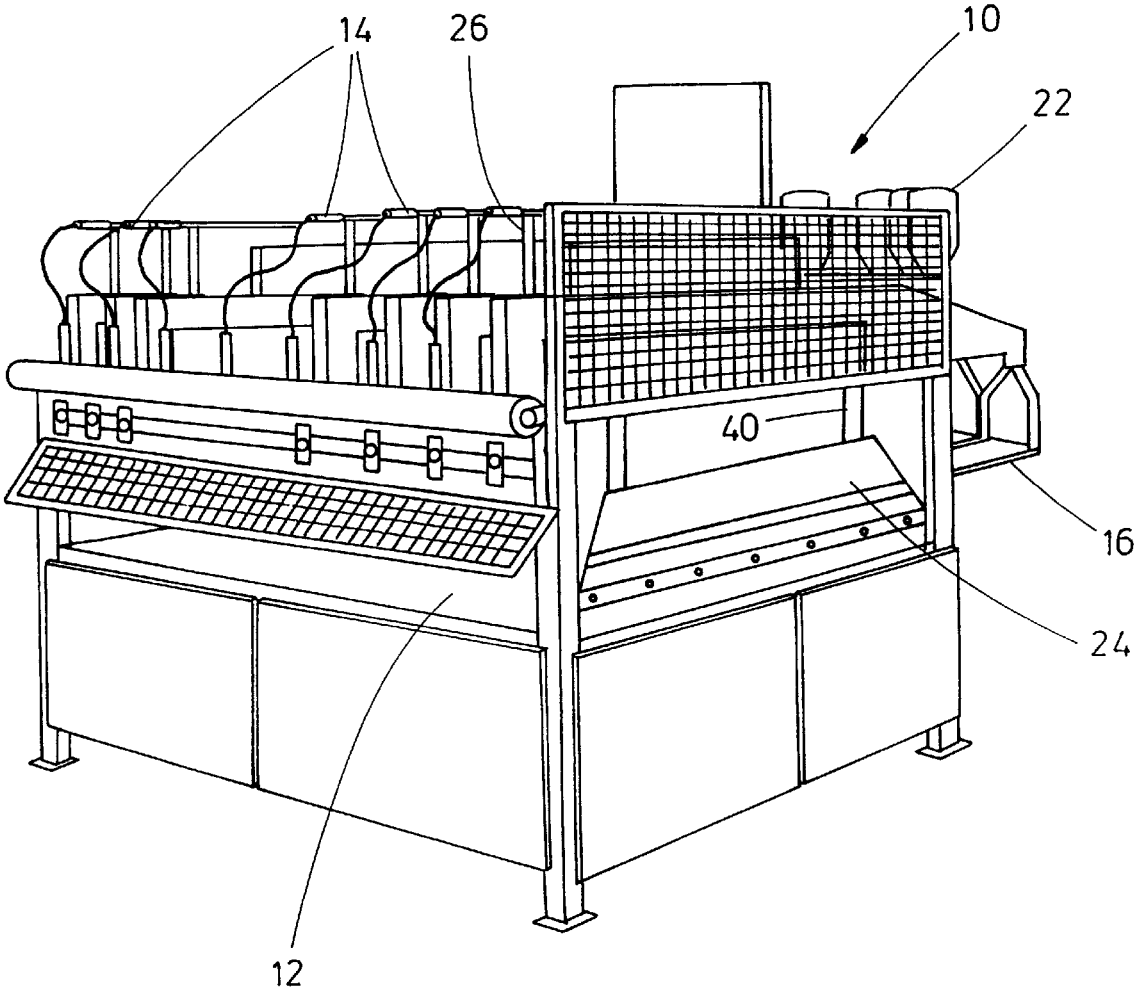
FIG. 1 shows a perspective view of the apparatus according to the inventions
Figure 2:
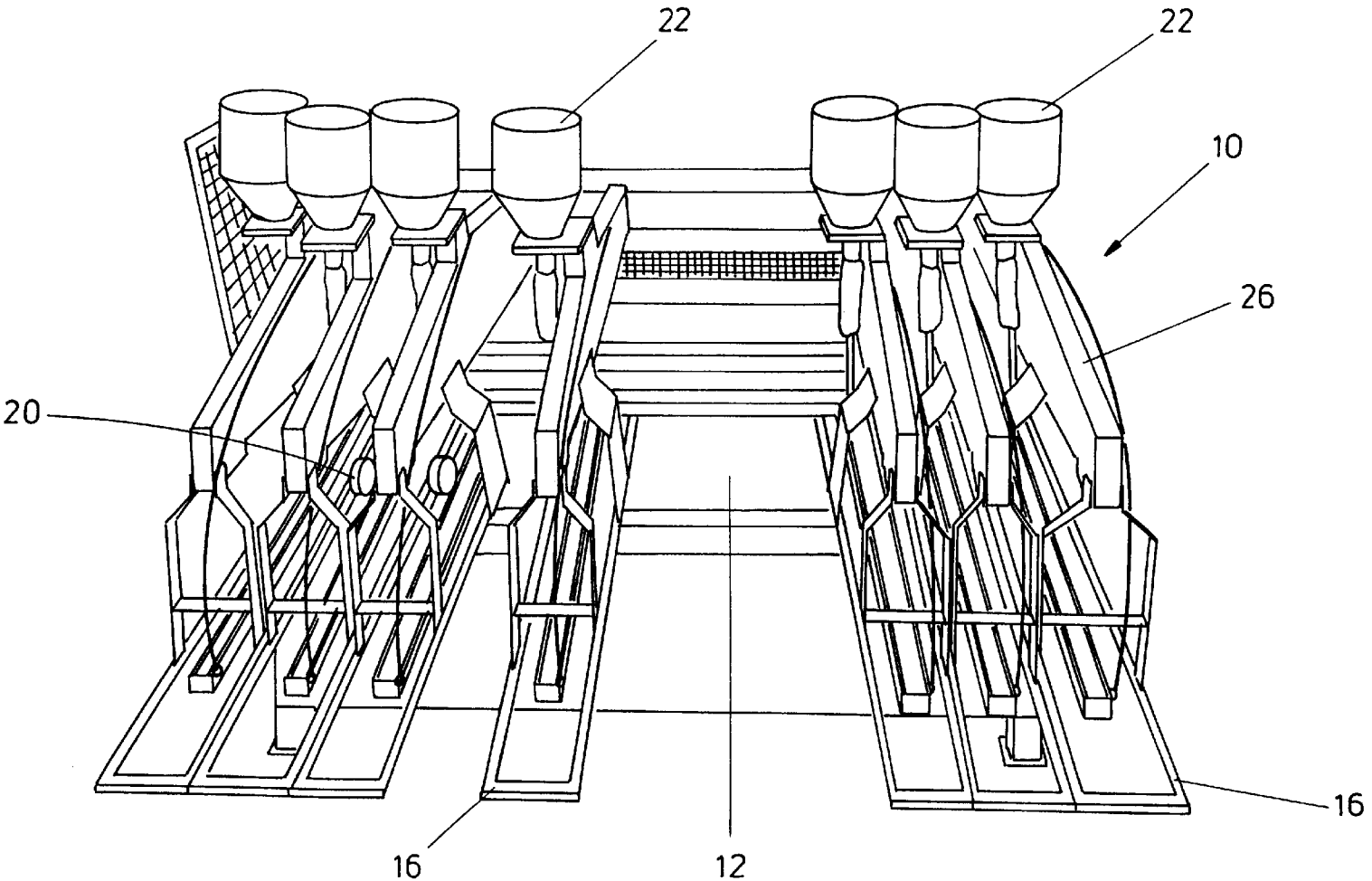
FIG. 2 shows a perspective view of the forming stations.
Figure 3:
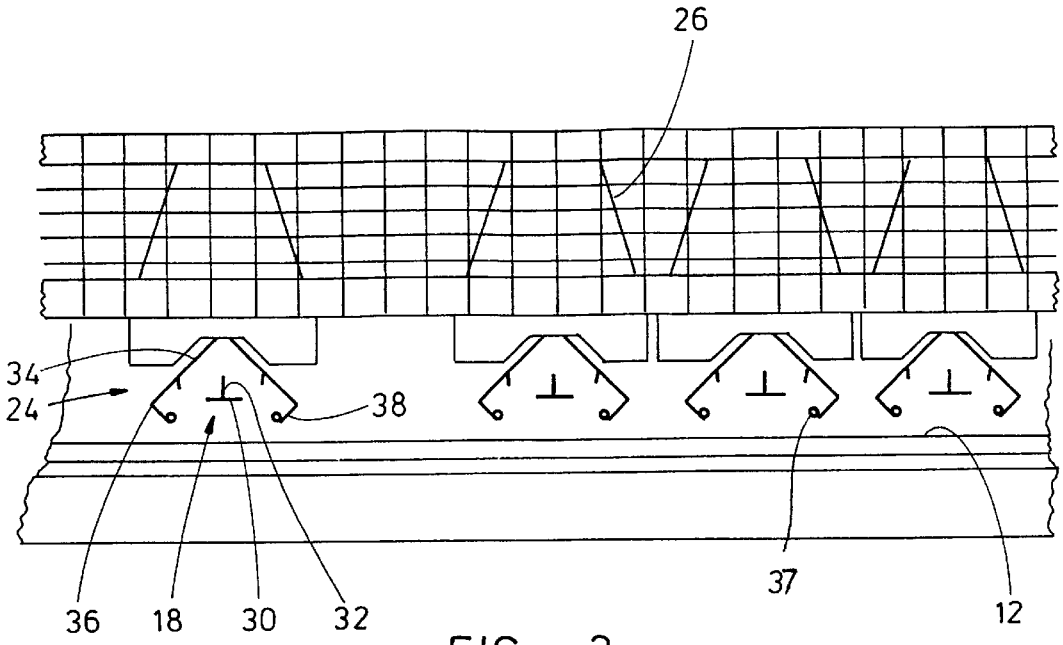
FIG. 3 shows an end view of the formers and forming bars.
Figure 4:
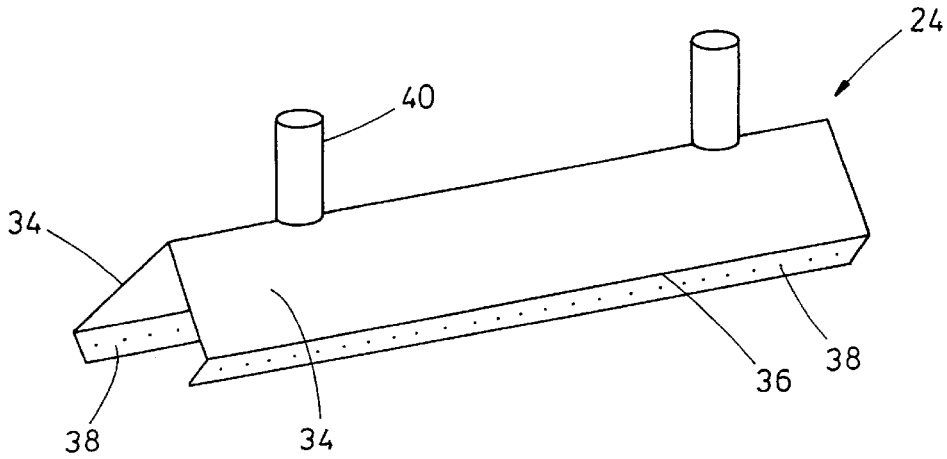
FIG. 4 shows, diagrammatically, a perspective view of a former.
Figure 6:
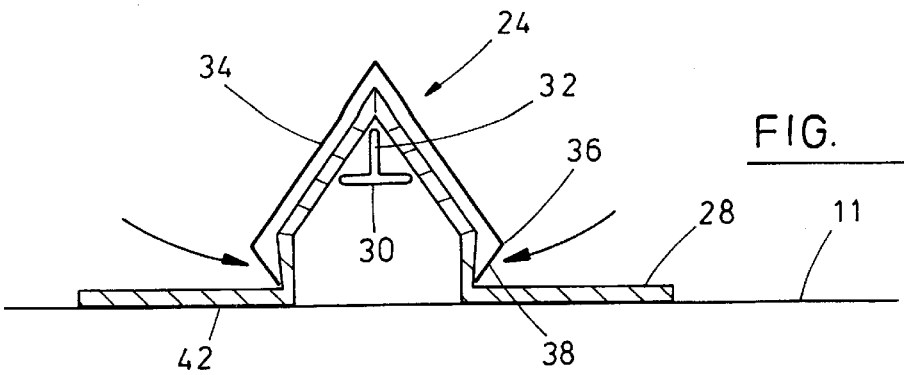
Figure 5A:
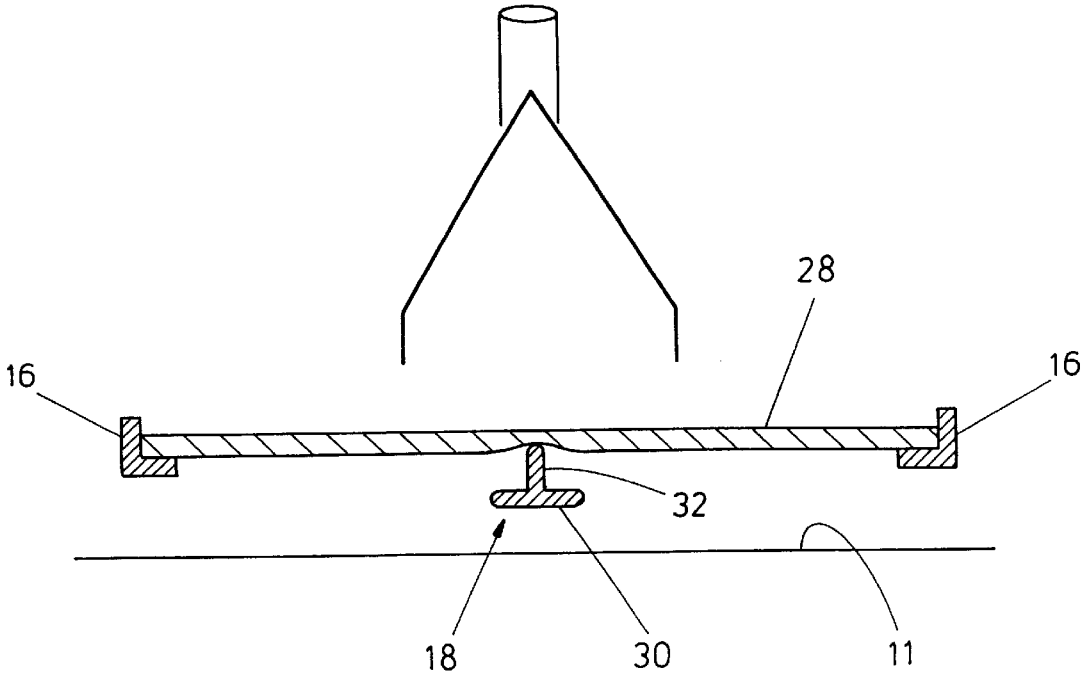
Figure 5B:
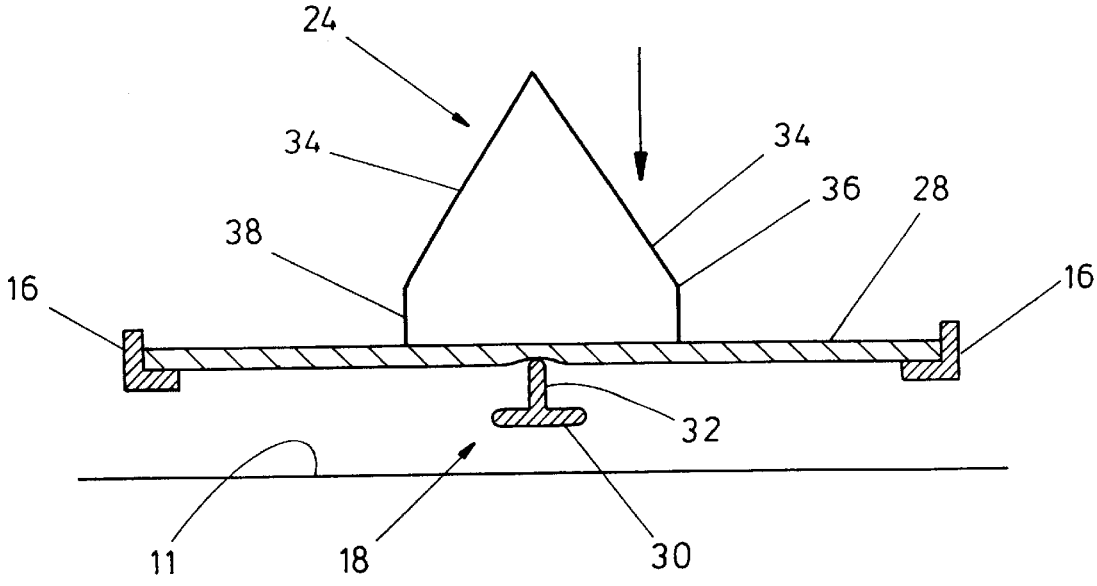
Figure 7:
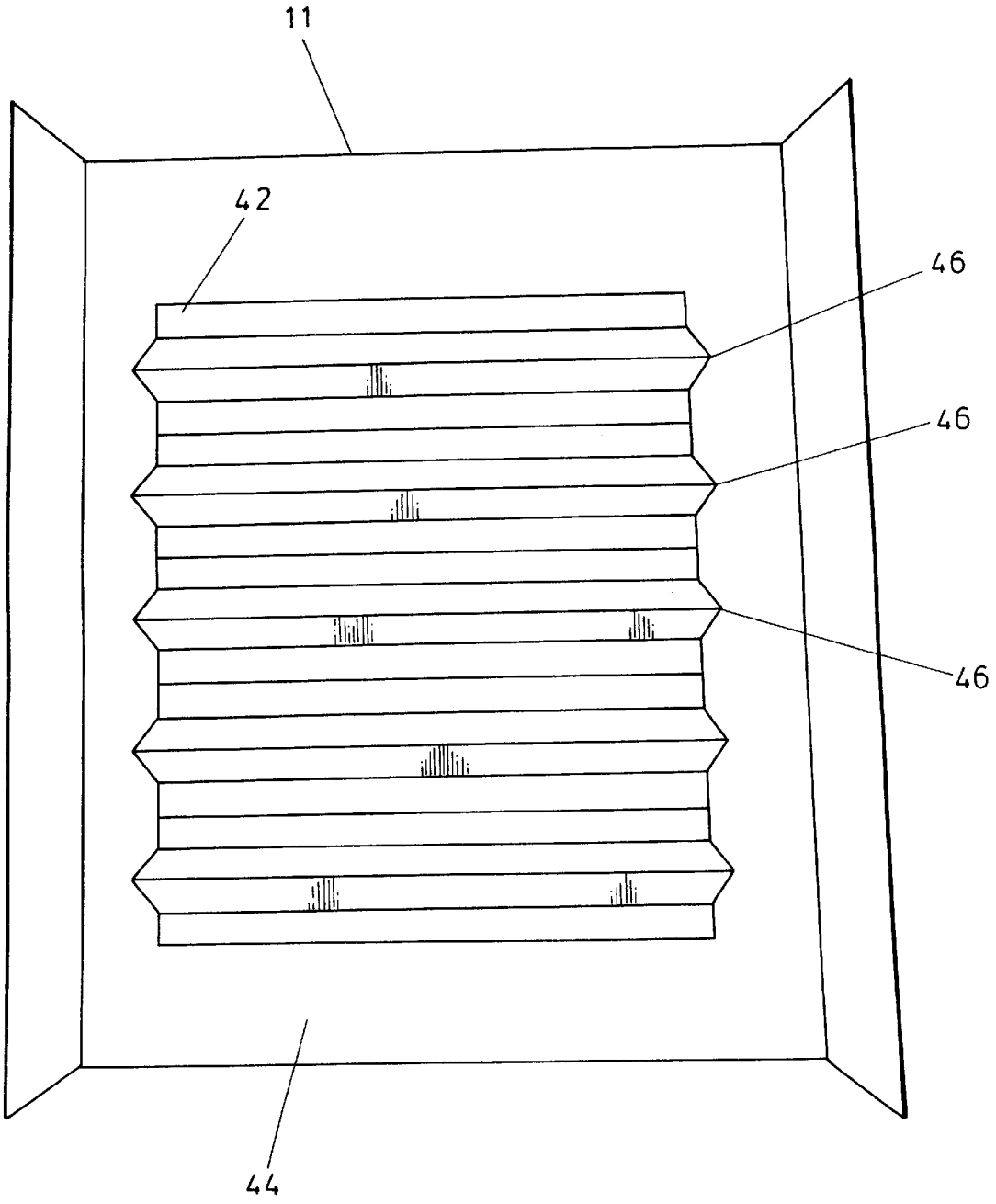

FIGS. 5*a* and 5*b* show, diagrammatically, the position of the former, forming bar and rib blank prior to and during downward movement of the former;

FIG. 6 shows diagrammatically the "pinching" action of the spring loaded regions of the sides of the former; and FIG. 7 shows a stiffening panel with reinforcing ribs.

As shown in the drawings the apparatus 10 for forming stiffening panels having stiffening elements in the form of ribs comprises a bed 12 to receive a planer panel (11) onto which the ribs will be formed and secured thereto. Located above the bed 10 are a plurality of forming stations 14. Each forming station 14 includes a support means 16, a forming bar 16, roller means 20, an adhesive reservoir 22 and a former 24. The forming stations 14 are supported on a frame 26 and are moveable in relation to one another on the frame 26. Means are provided for actuation of the above-mentioned elements where required.

The region of the support 16 which extends past the bed 12 acts as a means whereby the rib blank may be supported and fed into the apparatus 10 so as to located in the required position, under the former 24, prior to shaping and folding.

Rollers 20 are provided to move the rib blank 28 along the support 16 into the required position. The rollers 20 also act to distribute a measured amount of hot melt adhesive, delivered from the reservoirs 22, along the edges of the rib blank 28.

The forming bar 18 is located beneath the support 16 and thus also beneath the rib blank 28 when the latter is located on the support 16. The forming bar 18 is moveable in a generally horizontal direction and can advance with the rib blank 28, maintaining its position beneath it. The shape and configuration of the forming bar 18 is of an inverted T having a substantially horizontal lower portion 30 and an upstanding portion 32 located centrally of the lower portion 30.

The former 24 is located above the bed 10, each forming station 12 has a dedicated former 24. Each former 24 comprises an elongate metal fabrication having a cross sectional shape of an inverted V. The lower portions of the arms 34 are provided with hinges 36 or are spring loaded. The edges 38 of the arms 34 are rounded. Supports 40 are provided to secure the former 28 to the frame 26 and actuating means are also provided to move the former 28 as required.

In use, a planer panel 11 which is to receive the reinforcing ribs, is fed into the apparatus 10 and placed on the bed 12. Pre-creased rib blanks 28 are placed on the portion of the support 16 which extends outwardly of the apparatus 10. Rollers 20 are actuated and move the rib blank 28 along the support towards the bed 10 whilst at the same time acting to coat the edges of the rib blank 28 with adhesive. As the rib blank 28 is moved towards the bed 10, the forming bar 18 is caused to move to follow the movement of the rib blank 28 maintaining a position beneath it. Movement of the rib blank 28 and the forming bar 18 continues until both are located above the planer panel positioned on the bed 10. Once the rib blank 28 and the forming bar 18 are in the required position, the former 24 is activated to move downwards towards the rib blank 28. Continued downward movement of the former 24 causes it to contact the rib blank 28, and this downward pressure causes the rib blank 28 to be dislodged from the support 16 and brought into contact with the forming bar 18. More particularly, the rib blank 28 contacts the top of the vertical portion 32 of the forming bar 18 in the region of the primary pre-formed crease. The vertical portion 32 of the forming bar 18 resists the downward movement of the rib blank 28 as it is pushed by the former 24. This causes the rib blank 28 to fold around the forming bar, along the line of the primary pre-formed crease.

Due to the shape of the former 24, being an inverted V, the sides or arms of the inverted V pass either side of the forming bar 18. The hinged portions 36 of the arms 34 act to exert a gripping or "pinching" action on the rib blank 28 as it is bent around the forming bar 18. The action of the hinged portions 36 is in the region of the secondary pre-formed creases causing the rib blank 28 to bend in this region. In addition, the action of the hinged portions 36 serves to prevent the rib blank 28 from flattening out as it is bent around the forming bar 18 and acts to push or "pinch" together the regions of the rib blank 28 which have been bent around the forming bar 28. This action assists to form the sides of the rib.

The pushing or "pinching" action of the former 24 also acts to assist the bonding of the formed rib to the planer panel. By exerting pressure in the region of the secondary pre-formed creases in the rib blank 28 to "pinch" the sides of the blank 28 together to form the rib, this has the effect of causing the region 42 of the rib blank between the secondary creases and the longitudinal edge to retain a substantially horizontal attitude. As the rib blank 28 is dislodged from the support 16, this causes the substantially horizontal regions 42 of the rib blank 28 to contact the upper face 44 of the planer panel. The adhesive carried on the edges of the rib blank contacts the planer panel and cures thus bonding the newly formed rib to the planer panel.

Once the ribs have been formed and bonded to the planer surface, the former 24 is moved away from the bed 10 in an upwardly direction and the forming bar 28, which is now located inside the reinforcing rib 46, is retracted from the bed, the stiffening panel now complete with reinforcing ribs located thereon, is removed and the process is repeated.

What is claimed is:

1. Apparatus for forming re-enforced stiffening panels for use with palletainers wherein reinforcement of panels is provided by stiffening elements in the form of ribs, said apparatus comprising:

a first support onto which a panel is presented, a second support onto which a rib blank is presented, at least one forming assembly for folding and shaping said rib blank, each said forming assembly including at least first and second forming elements, which cooperate to fold and shape a rib blank, with at least said second one of the forming elements having a cross-sectional shape of an inverted V, with sides thereof formed with a hinged or spring loaded region, an actuator for said at least one forming assembly, and an assembly for securing a folded and shaped rib to the panel.

2. Apparatus according to claim 1, wherein said first one of said forming elements comprises a shaped elongate metal fabrication.

3. Apparatus according to claim 2, wherein said first one of said forming elements has a cross-sectional shape of an inverted T.

4. Apparatus according to claim 1, wherein said second one of said forming elements comprises an elongate metal fabrication.

5. Apparatus according to claim 1, wherein a region of the sides of the second one of said forming elements which extend past a location of the hinged or spring loaded region exert a gripping or pinching action on the rib blank during folding and shaping.

6. Apparatus according to claim 1, wherein edges of the region of the sides of the second one of said forming elements are finished with a rounded portion.

7. Apparatus according to claim 5, wherein edges of the region of the sides of the second one of said forming elements are finished with a rounded portion.

8. Apparatus according to claim 1, wherein the forming elements are disposed one above the other.

9. Apparatus according to claim 1, wherein said first support comprises a substantially horizontal bed onto which the panel is presented prior to being provided with ribs.

10. Apparatus according to claim 1, wherein said second support comprises locating brackets or guide rails to receive a rib blank prior to folding and shaping.

11. Apparatus according to claim 10, further comprising at least one roller for causing the rib blank to travel along the locating brackets or guide rails into a required location for forming and shaping.

12. Apparatus according to claim 1, wherein said assembly for securing a folded and shaped rib to a panel comprises a reservoir for dispensing an adhesive to the rib blank prior to folding and shaping.

13. A method of forming re-enforced stiffening panels for use with palletainers wherein reinforcement of panels is provided by stiffening elements in the form of ribs, said method comprising the steps of:

presenting a panel to a forming apparatus, presenting a rib blank to said forming apparatus, arranging at least two forming elements to cooperate to fold and shape said rib blank, arranging a hinged or spring loaded region in sides of at least one of the forming elements to act on said rib blank during folding, and securing said folded and shaped rib blank to said panel.

14. A method of forming re-enforced stiffening panels for use with palletainers wherein reinforcement of panels is provided by stiffening elements in the form of ribs, said method comprising the steps of:

presenting a panel to a forming apparatus, pre-creasing a rib blank to promote creasing along at least one defined line, presenting the rib blank to said forming apparatus, arranging at least two forming elements to cooperate to fold and shape said rib blank, arranging a hinged or spring loaded region of at least one of the forming elements to act on said rib blank during folding, and securing said folded and shaped rib blank to said panel.

15. A method according to claim 14, further comprising the step of effecting such folding by means of a forming assembly.

16. A method according to claim 15, wherein the steps of arranging cause folding of said rib blank along three spaced fold lines.

17. A method according to claim 16, further comprising the step of causing a rib forming assembly to grip said rib in creased form to maintain said crease until said rib has been secured to said panel.

* * * * *